US007204295B2

(12) United States Patent
Schneider et al.

(10) Patent No.: US 7,204,295 B2
(45) Date of Patent: Apr. 17, 2007

(54) MOLD WITH A FUNCTION RING

(75) Inventors: Wolfgang Schneider, St. Augustin (DE); Manfred Langen, Bonn (DE); Stephen Instone, Bonn (DE)

(73) Assignee: Maerz-Gautschi Industrieofenanlagen GmbH, Tagerwilen (CH)

( * ) Notice: Subject to any disclaimer, the term of this patent is extended or adjusted under 35 U.S.C. 154(b) by 0 days.

(21) Appl. No.: 10/951,950

(22) Filed: Sep. 28, 2004

(65) Prior Publication Data

US 2005/0061468 A1 Mar. 24, 2005

Related U.S. Application Data

(63) Continuation-in-part of application No. 10/115,808, filed on Mar. 28, 2002, now abandoned.

(51) Int. Cl.
*B22D 11/049* (2006.01)
*B22D 11/07* (2006.01)

(52) U.S. Cl. ..... 164/444; 164/268; 164/472; 164/487

(58) Field of Classification Search ..... 164/487, 164/444, 472, 268
See application file for complete search history.

(56) References Cited

U.S. PATENT DOCUMENTS 4,598,763 A 7/1986 Wagstaff et al.
4,732,209 A * 3/1988 Apostolou et al. ..... 164/475
5,320,159 A * 6/1994 Schneider et al. ..... 164/268
5,325,910 A * 7/1994 Schneider et al. ..... 164/472
5,873,405 A * 2/1999 Carrier et al. ..... 164/472

FOREIGN PATENT DOCUMENTS

EP 0 566 865 B1 10/1993
FR 2 534 832 4/1984
GB 2 129 344 A 5/1984

OTHER PUBLICATIONS

Patent Abstracts of Japan, vol. 006, No. 017, Jan. 30, 1982, & JP 56 136257 A (Sumitomo Light Metal Ind Ltd.).
Patent Abstracts of Japan, vol. 006, No. 120, Jul. 3, 1982, & JP 57 047556 A (Showa Alum Ind KK), Mar. 18, 1982.
Patent Abstracts of Japan, vol. 013, No. 392, Aug. 30, 1989 & JP 01 138043 A (Showa Denko KK), May 30, 1989.

* cited by examiner

*Primary Examiner*—Kuang Y. Lin
(74) *Attorney, Agent, or Firm*—Marshall, Gerstein & Borun LLP

(57) ABSTRACT

The invention relates to a hot-top mold for a strand casting apparatus, consisting of a hot-top, which lies on the upper side of a parting agent distributor and presses it with its underside against the surface of a mold, an overhang being formed on the radially inner surface of the hot-top, which protrudes beyond the parting agent distributor in the direction of take off of the strand, the hot-top being centered and held by an outer ring, which is releasably fastened to the mold. The mold surrounds a function ring toward the bearing surface of the mold which, together with the parting agent distributor, forms function surfaces with adjustable roughness on the surfaces. In the parting agent distributor, radial channels are formed at the upper side and the underside, the channel cross sections at the upper side and the underside being in a ratio of 1:3 to 1:5 to one another.

12 Claims, 5 Drawing Sheets

MOLD WITH A FUNCTION RING

CLAIM OF PRIORITY

This patent application claims the benefit of priority, under 35 U.S.C. § 120, as a continuation-in-part of U.S. patent application Ser. No. 10/115,808, filed Mar. 28, 2002, entitled "Mold with a function ring", now abandoned, which is herein incorporated by reference in its entirety.

FIELD OF THE INVENTION

The present invention relates to continuous casting of molten metal. More particularly, the invention relates to a process and apparatus for top-feed casting of metals and for improving the surface quality of aluminum and other hard-to-cast alloys thereof.

BACKGROUND OF INVENTION

Strand casting, also known as continuous casting, involves a process in which molten metal is introduced into a mold. During its residence time in the mold, the metal solidifies in contact with the wall of the mold and can be drawn downward via a movable bottom portion of the mold. A reserve of molten metal is positioned above the mold in what is referred to as a feeder head or a "hot-top". A parting agent, or release agent, is applied to the surface of the continuous casting being formed, such that direct contact with the surface of the mold is avoided, thereby facilitating easy removal of the casting. Parting agents may include mixtures of oils and gases. It is particularly desirable if the oil-gas mixture is first formed close to the mold.

Hot-top molds of the kind described above are well known in the art. U.S. Pat. No. 5,320,159 to Schneider et al. discloses a hot-top mold where a parting agent, by way of a parting agent distributor, reaches the surface of the cast strand. Two different parting agents such as oil and gas, may be fed separately or as a mixture.

Certain hard-to-cast alloys, such as aluminum alloys containing lead, zinc, tin and copper, pose casting problems that can result in poor surface quality. Recently, such alloys have been gaining importance in the production of special alloys and machining alloy stock, which are to be used at a high cutting speed. Additionally, when the parting agent supply is insufficient or not uniformly regulated, surface and edge structural defects can develop in the casting. These include, in particular, surface irregularities or in-homogeneities in the structure near the surface.

One problem which contributes to the surface irregularities spoken about above and determines whether the parting agent reaches the entire surface of the metal strand is the precise control of the gas pressure. Pressure fluctuations can result in surface flaws, and pressure that is too high may pose a risk that gas might escape through the molten metal.

U.S. Pat. No. 4,732,209 to Pechiney attempts to solve this problem by using a graphite ring on the inside of the mold and a gas under pressure that is forced from the outside through the open pores of a feeder head to the inside of the mold and thereby acts as a parting agent between the surface of the forming metal strand and the mold surface. However, while this solution addresses the problem of controlling gas pressure, this solution cannot be applied to hard-to-cast alloys.

SUMMARY OF THE INVENTION

The present invention is directed to a hot-top mold that permits different types of alloys, in particular hard-to-cast alloys, to be made with an improved surface quality.

The present invention comprises a hot-top ring, which lies on top of a parting agent distributor and presses it against the surface of a mold. An overhang on the inner surface of the hot-top ring extends beyond the parting agent distributor in the downward direction of the movement of the strand and forms an annular gap with the running surface of the mold. A function ring is position on the inner surface of the mold and forms a function surface with the parting agent distributor through which gaseous and liquid parting agents are delivered.

The hot top can be disassembled for use with different alloys. A gaseous parting agent and a liquid (e.g. oil) are introduced into the parting agent distributor. The parting agent distributor and function ring may produce a foam layer to be used as a parting agent which permits improved surface quality, particularly for hard-to-cast alloys.

DESCRIPTION OF PREFERRED EMBODIMENT

Figure 1:
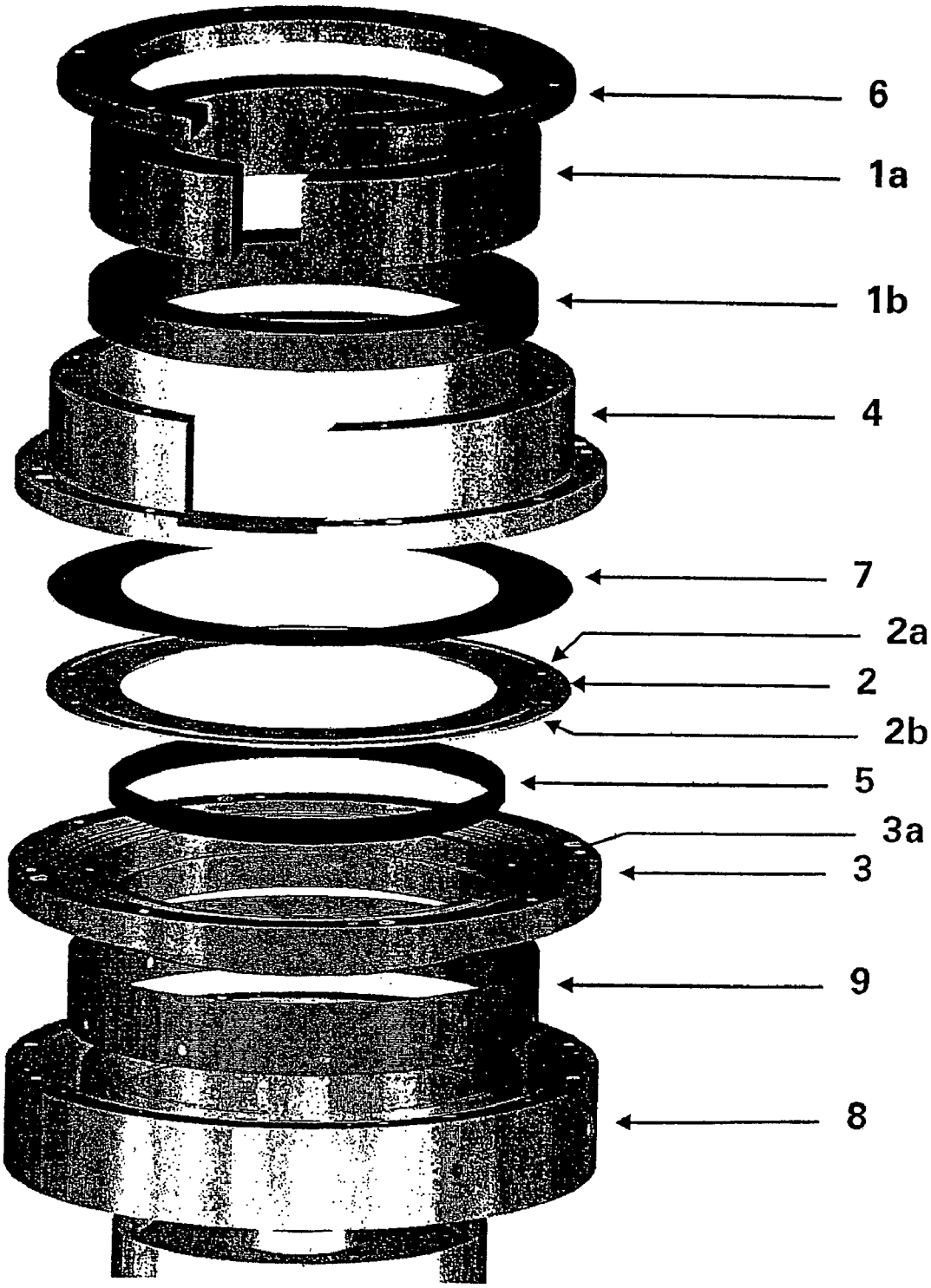
FIG. 1 is an exploded perspective view of a hot-top mold used in strand casting in accordance with a preferred embodiment of the invention.
Figure 2:
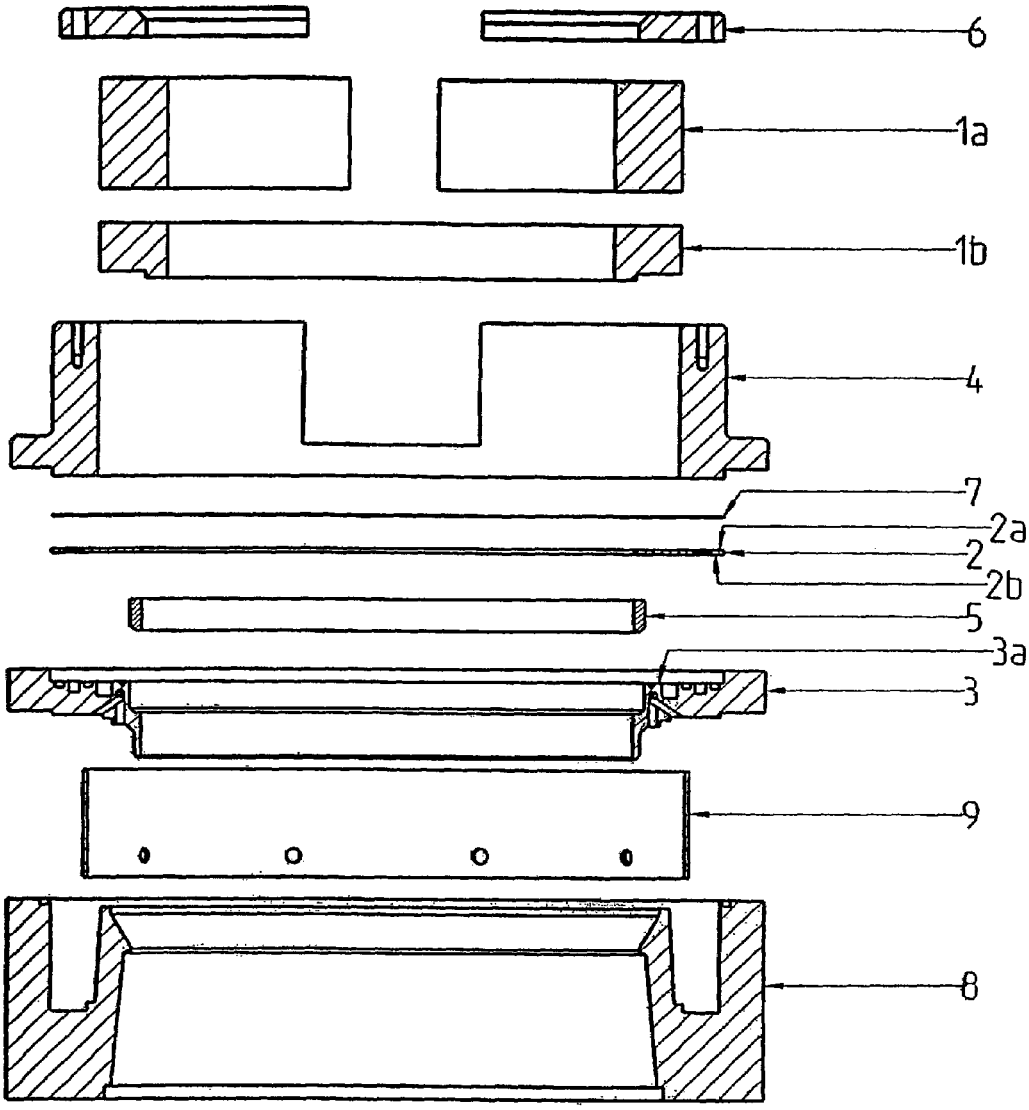
FIG. 2 is an exploded longitudinal cross section of the hot-top mold of FIG. 1.

As shown in FIG. 1, a hot-top mold 1 comprises an upper ring 1*a* and a lower ring 1*b*. Lower ring 1*b* has a thermal conductivity of approximately 1.5 to 2.0 times greater than that of upper ring 1*a*. Rings 1*a*, 1*b* are secured within the radially inside surface of an outer ring 4 which is releasably fastened to a mold 3. Mold 3 surrounds at its inner surface a function ring 5, whose upper end forms a function surface with a parting agent distributor 2. A clamping ring 6 secures hot-top rings 1*a*, 1*b*, parting agent distributor 2, mold 3, and outer ring 4. An activator ring 7 lies between outer ring 4 and parting agent distributor 2 and is in contact with a top surface 2*a* of the distributor 2. A bottom part 8 and pressure plate 9 compete the lower portion of mold 3.

Rings 1*a*, 1*b* of hot-top mold 1 are easy to assemble and disassemble, facilitating the quick exchange of different parting agent distributors 2 and function rings 5 according to the desired type of alloy. Loosening clamping ring 6 and outer ring 4 permits replacement of the parting agent distributor 2 and function ring 5.

Figure 4A:
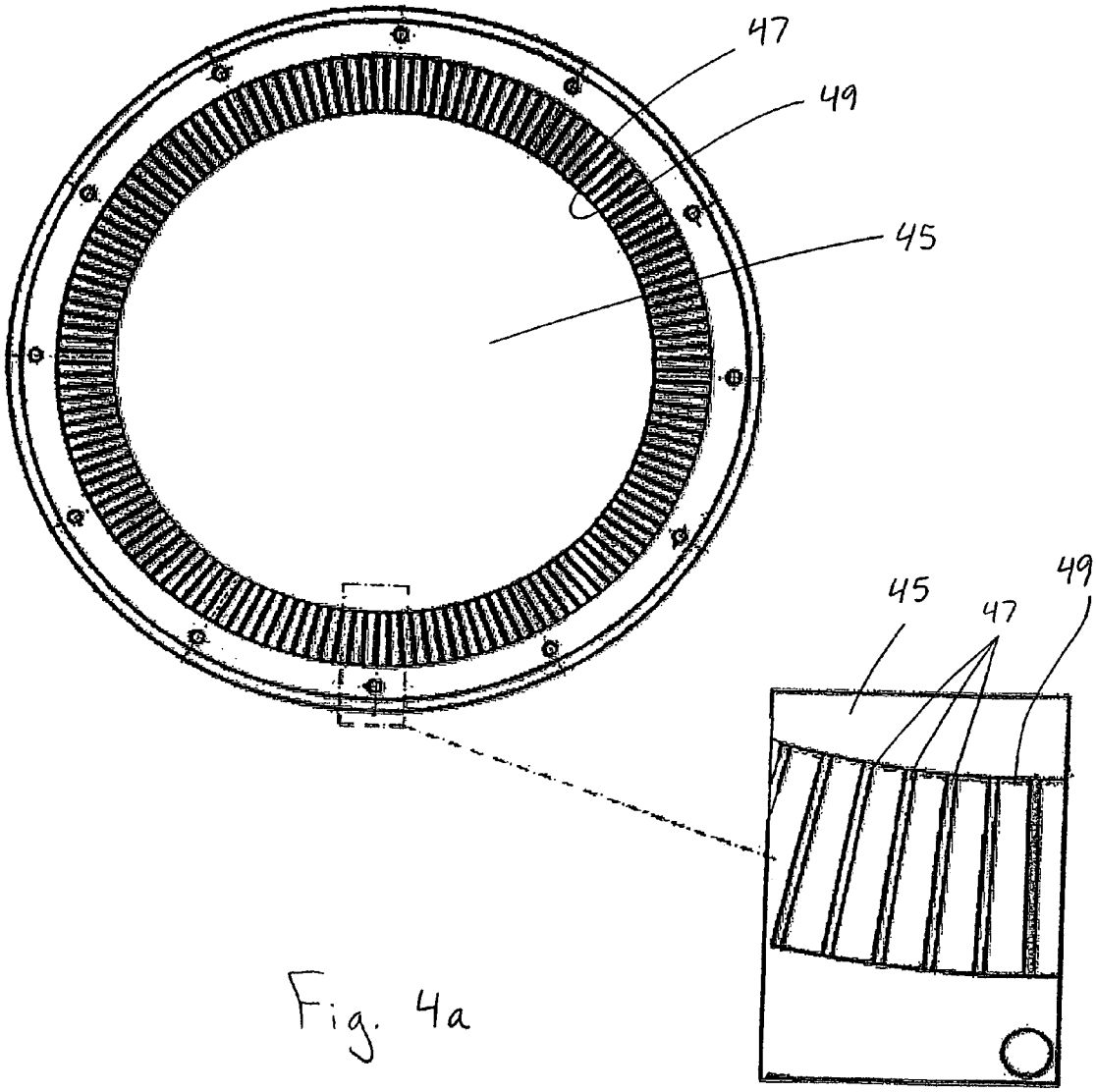
FIG. 4*a* is a top view of a parting agent distributor plate illustrated in FIGS. 1–3.
Figure 4B:
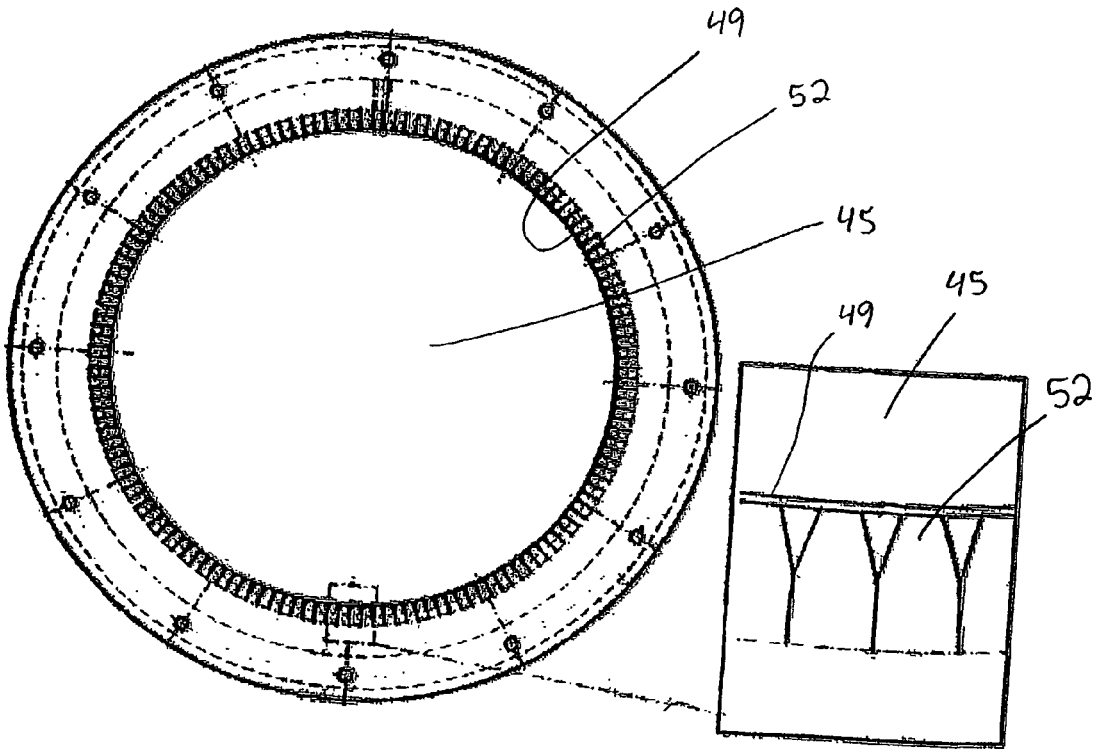
FIG. 4*b* is a bottom view of a parting agent distributor plate illustrated in FIGS. 1–3.

Referring to FIGS. 4*a* and 4*b*, top and bottom surfaces of parting agent distributor 2 are shown respectively. Parting agent distributor 2 is completely round or annular and contains a circular cross sectional opening 45. Etched or laser-cut radial channels 47 are distributed radially around the circumference at essentially equal intervals and terminate perpendicularly at edge 49. Referring to FIG. 4*b*, radial channels 52 are tapered toward edge 49 so that the liquid parting agents supplied therethrough escape at increased velocity or pressure against the outer surface of the casting metal where the parting agent is cooled and lowered into annular cavity 11 for distribution into annular gap 11. The cross sections of the channels may be in a ratio of 1:3 to 1:5 between top and bottom sides. This ratio is important for controlling the composition of the parting agent mixture. By matching the surface and channel cross sections, foam production is easily possible. Foam is especially effective as a highly viscous parting agent and permits an improved surface quality, particularly for hard-to-cast alloys.

Function ring 5 includes surfaces facing the parting agent distributor 2 and the mold 3. Function ring 5 may comprise copper or copper alloys. It may also comprise ceramic, composite materials or graphite. The function ring surfaces (function surfaces) provide walls with a defined roughness for the radial channels on parting agent distributor 2. It is especially desirable if a function surface forms one wall face for the liquid-bearing channel. With a precisely adjusted surface roughness and temperature of the function surfaces, a defined change in the viscosity of the fluid parting agent can be achieved for producing a stable foam layer.

According to a preferred embodiment, a tight porosity of function ring 5 and a specific density is chosen within narrow limits, such as a closed porosity of 0–20% and a density of 1.5–10 g/cc. Additional improvements in the stability of the parting agent foam can be achieved by cooling function ring 5 in order to keep the viscosity properties on the function surfaces constant. The construction and manner of operation of the function surfaces and the cooling is further explained below.

Referring to FIGS. 4*a* and 4*b*, the radial channels 47 on the top surface 2*a* of parting agent distributor 2 are used preferably to form gas-carrying passages, and the radial channels 52 on the bottom surface 2*b* are used as liquid-carrying passages. Accordingly, the passages incorporated into the upperside 2*a* are connected to a pressurized gaseous medium, while the passages on the underside 2*b* are connected to a pressurized liquid reservoir. These passages (radial channels) must be made with very great precision, which can be achieved by laser machining, a chemical etching method, or other techniques. The cross-sectional shape of the radial passages controls for the air content in the parting agent foam and the surface area ratio of the passages controls the formation of a parting agent foam distributed uniformly over the circumference. It is preferred that the liquid-carrying passages be configured in the manner of a nozzle, with an approximately square cross section being given to each radially outward lying passage of surface 2*b* and also a rectangular cross section with a surface ratio of at least 1:2 formed on the radially inward lying exit side. Under these circumstances the parting agent is formed with especially fine cells and hence it is strong, thereby reducing the liquid component of the parting agent.

The formation of certain function surfaces, such as the gas and liquid carrying passages described above as well as annular channel 11 and the area directly inside the function ring 5, is critical to the formation of a stable parting agent foam. The annular channel 11 is in direct contact with the passages of the parting agent distributor 2 and cooperates in the formation of the foam.

As an innovative and supplementing feature of the function surfaces, activator ring 7, which can be made of various materials, lies between outer ring 4 and the top 2*a* of the parting agent distributor 2. It thus covers the top of the gas-carrying passages made in parting agent distributor 2. Its roughness values differ from those of the hot-top ring 1*b* and can be adjusted to the particular requirements of the parting agent, and thereby control the thermal gradient of parting agent distributor 2.

Function ring 5 is preferably cooled by arranging cooling passages 15 (FIG. 3), in mold 3, which extend into the area underneath parting agent distributor 2 and function ring 5. In this primary cooling zone, a temperature is established for the optimum action of the parting agent. An adjoining annular gap 14 forms a secondary cooling zone providing rapid removal of heat in the annular gap 14 and the foam layer 16. This secondary cooling zone runs in the direction of the descent of the strand and into a slot nozzle 53. Here, the pressure of the coolant is lowered and is directed into contact with the aluminum strand permitting heat dissipation thereof.

Mold 3 is supplemented by an outer ring 4 and a function ring 5. By means of a clamping ring 6, the system parts are assembled together with the inclusion of an activator ring 7. The mold is completed by a bottom part 8 and a pressure plate 9. Pressure plate 9 stands in connection on its top end with mold 3 and on its bottom end with the bottom part 8. The pressure plate 9 supports mold 3 above a liquid reservoir 42 (used as a coolant) and is used to avoid deflections in the mold 3. The use of pressure plate, as used in this fashion, is a common measure taken to avoid deflections of the supported member, e.g., to avoid deflection of the mold 3.

Figure 3:
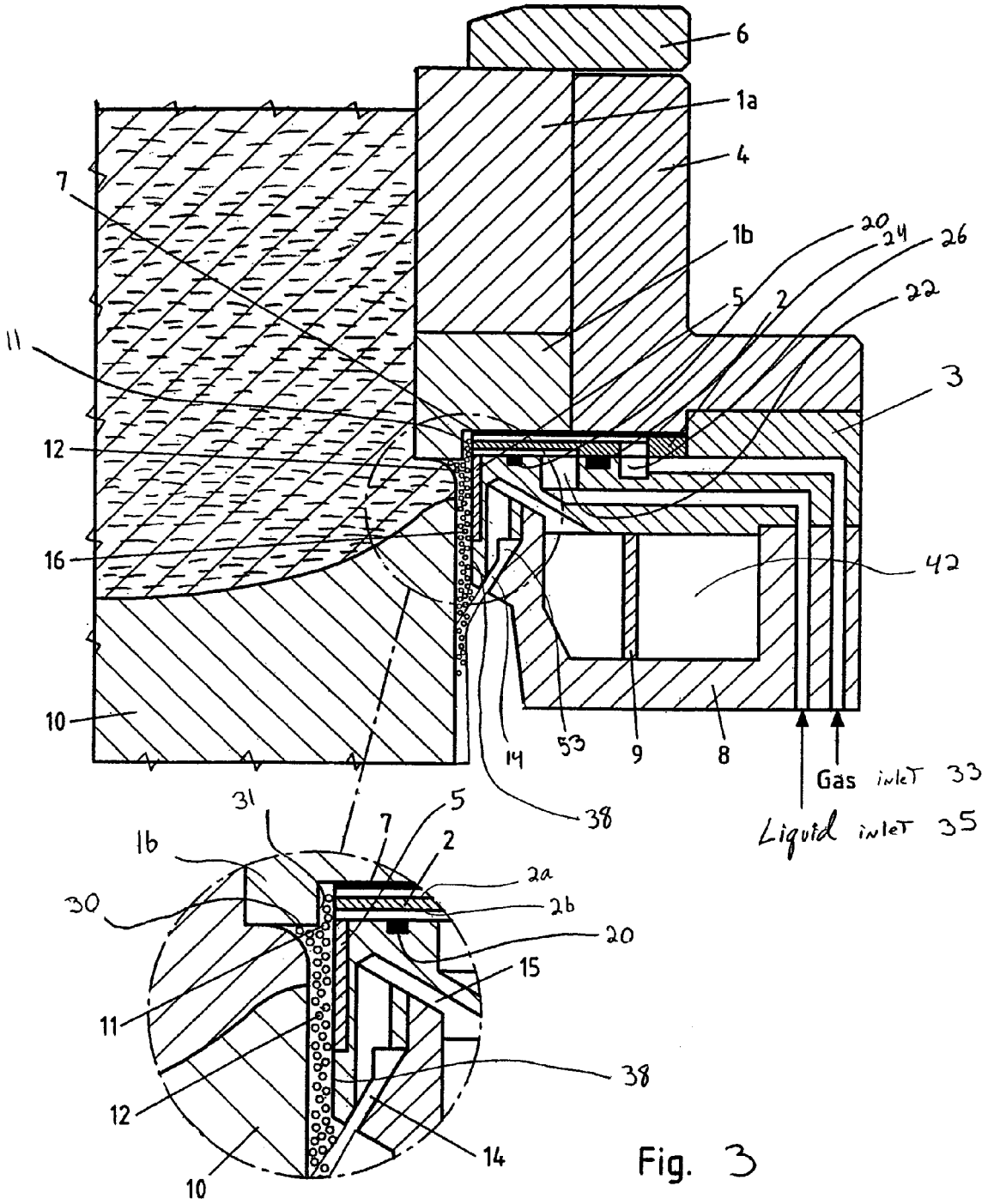
FIG. 3 is a partial cross section view of the hot-top mold of FIG. 1.

FIG. 3 illustrates the basic construction of a hot-top casting mold according to the present invention. An annular gap 11 exists adjacent wall 31 of an overhang portion in hot-top ring 1*b*. The side walls of annular gap 11 are formed by the hot-top overhang and by the radial inner wall of parting agent distributor 2, the function ring 5 and the activator ring 7. Upon the introduction of gaseous and liquid parting agents within the volumetric ratio of the invention at respective gas and liquid inlets 33 and 35, a stable parting agent foam 12 is formed, which develops as a continuous layer of foam between the mold 3 and the metal strand 10.

Initially, the viscosity of the parting agent foam 12 is controlled by the surface roughness in the gas and liquid passageways and is an essential factor in the formation of the foam. Furthermore, the pressure and flow rate of the delivered gaseous and liquid parting agents can be controlled, thereby regulating the composition of the parting agent foam within wide limits. This control over the gaseous and liquid parting agents provides for a controlled heat removal and is particularly advantageous for hard-to-cast alloys.

Referring to FIG. 3, during the casting process, molten metal is introduced to the continuous casting mold from above. The molten metal forms a meniscus where wall 31 of overhang 30 meets function ring 5 at a right angle.

In operation, gas and liquid are ejected from the respective top and bottom radial channels of parting agent distributor 2 through the annular channel 11 to the meniscus. Various types of gases which can be used include, but are not limited to: air, nitrogen, argon, CO2 and Freon. The force of the gas traveling through annular channel 11 causes parts of the liquid separating agent or lubricant, e.g., oil, to entrain with the gas. A parting agent foam or emulsion of gas and lubricant/separating agent forms and travels in laminar flow below the overhang 30 in the draw-off direction (the direction of the flowing cast metal) and parallel to the radial inside surface of function ring 5.

As the cast metal flows downwardly, the molten metal starts to solidify. Along the inner edge of the function ring 5, the cast metal is at least partially solidified. At the beginning of a casting run the solid metal first presented along the function ring 5 is called the starter block. The parting agent foam travels along the gap present between the starter block and running surface 38 of mold 3. Below the running surface 38 a water stream passes from the cooling passage 15 through the annular gap 14.

Cooling passage 15 extends proximate the agent distributor 2 and the function ring 7 and provide two cooling functions. First, coolant passing through passage 15 acts to cool distributor 2 and function ring 7, forming a first cooling zone. The liquid conducted through cooling passage 15 is directed into a slotted nozzle (slot nozzle 53) formed by annular gap 14 and is sprayed on the descended strand forming a second cooling zone. Unlike the first cooling zone, this liquid stream provides rapid heat removal from the cast strand through the foam layer 16. Additionally, leading the water stream into slot nozzle 53 lowers the pressure of the coolant.

Annular gap 14 is directed towards the starter block and a water stream is forced through annular gap 14 towards the block. The direction of flow of the water stream causes the formation of a vacuum, drawing the parting agent foam downwardly along running surface 38 and the edge of the starter block. The vacuum causes the formation of a foam veil, which completely shields the function ring 5 and wall 38 from the liquid metal, presently above the starter block.

The mixing of the gas with the lubricant and /or separating agent occurs variably between 2 and 10 mm before the outlet opening of annular channel 11. The ability to predetermine the point of mixing allows the mixing process to be optimized. The actual point of mixing is dependent on the configuration of the parting agent distributor. Also, different oils having different viscosities exhibit different mixing behavior with various gases.

We claim:

1. A continuous metal casting mold for casting a strand comprising:

a mold;

a parting agent distributor comprising a plurality of radial passages on its top and bottom surfaces adapted to be connected respectively to gas and liquid parting agent sources, wherein the bottom surface of the parting agent distributor abuts a top surface of the mold;

a hot-top ring lying above the parting agent distributor, having an overhang protruding beyond the parting agent distributor in the withdrawal direction of the strand and forming an annular gap with a surface of the mold for receiving gas and liquid parting agents from said radial passages;

an outer ring releasably fastened to the mold for centering and holding the hot-top ring;

a function ring surrounded by the mold positioned proximate to an inner surface of the mold, the upper surface of the function ring abutting the bottom surface of the parting agent distributor, whereby liquid passing through the radial passages in the bottom surface of the parting agent distributor passes over the upper surface of the function ring.

2. The casting mold of claim 1, further comprises a clamping ring disposed above the hot-top ring for securing the hot-top ring, the parting agent distributor, the function ring and the mold in place.

3. The casting mold of claim 1, wherein the function ring has a closed porosity of 0–20% and a density of 1.5–10 g/cc.

4. The casting mold of claim 1, wherein the plurality of radial passages on the top surface of the parting agent distributor are adapted to be connected to a pressurized gaseous medium and the plurality of radial passages on the bottom surface of the parting agent distributor are adapted to be connected to a liquid reservoir.

5. The casting mold of claim 1, further comprising cooling passages in the mold for removing heat, which reach into an area underneath the parting agent distributor and the function ring.

6. The casting mold of claim 1, wherein said hot-top ring is a lower hot-top ring part, and said mold comprises an upper hot-top ring part on top of said lower hot-top ring part and the thermal conductivity of said lower part is 1.5 to 2.0 times greater than that of the upper part.

7. The casting mold of claim 1, wherein the top surface of the parting agent distributor is covered by an activator ring.

8. The casting mold of claim 1, wherein the cross sections of the passages in the top and bottom surfaces of the parting agent distributor are in a ratio of 1:3 to 1:5.

9. The casting mold of claim 1, wherein the function ring is made of copper or copper alloys.

10. The casting mold of claim 1, wherein the function ring is made of ceramic or composite materials.

11. The casting mold of claim 1, wherein the function ring is made of graphite material.

12. The casting mold of claim 1, wherein the radial passages on the bottom surface of the parting agent distributor are configured in the manner of a nozzle having an approximately square cross section on a radially outward lying passage of the parting agent distributor and a rectangular cross section with a surface ratio of at least 1:2 on a radially inward-lying exit side of the parting agent distributor.

* * * * *

UNITED STATES PATENT AND TRADEMARK OFFICE

CERTIFICATE OF CORRECTION

PATENT NO. : 7,204,295 B2
APPLICATION NO. : 10/951950
DATED : April 17, 2007
INVENTOR(S) : Wolfgang Schneider et al.

It is certified that error appears in the above-identified patent and that said Letters Patent is hereby corrected as shown below:

On the Title Page:

At field (73), "Tagerwilen" should be -- Tägerwilen --.

At field (30), add -- 10115999.4, DE, March 30, 2001 --.

Signed and Sealed this

Twenty-ninth Day of July, 2008

JON W. DUDAS
*Director of the United States Patent and Trademark Office*